US008382235B2

(12) United States Patent
Akahane

(10) Patent No.: US 8,382,235 B2
(45) Date of Patent: Feb. 26, 2013

(54) LIQUID EJECTING HEAD, LIQUID EJECTING HEAD UNIT AND LIQUID EJECTING APPARATUS

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 13/006,307

(22) Filed: Jan. 13, 2011

(65) Prior Publication Data

US 2011/0187796 A1 Aug. 4, 2011

(30) Foreign Application Priority Data

Feb. 3, 2010 (JP) ..... 2010-021894

(51) Int. Cl.
*B41J 2/045* (2006.01)
*B41J 2/165* (2006.01)

(52) U.S. Cl. ..... 347/27; 347/56
(58) Field of Classification Search ..... 347/27
See application file for complete search history.

(56) References Cited

U.S. PATENT DOCUMENTS

2010/0238242 A1* 9/2010 Rittgers et al. ..... 347/86

FOREIGN PATENT DOCUMENTS

JP 2004-042559 2/2004

* cited by examiner

*Primary Examiner* — Jerry Rahll
(74) *Attorney, Agent, or Firm* — Workman Nydegger

(57) ABSTRACT

There is provided a liquid ejecting head including pressure generation chambers that communicate with nozzle openings from which liquid droplets are discharged, liquid flow paths that communicate with the pressure generation chambers, and pressure generation units that generate pressure for discharging liquid droplets in the pressure generation chambers. In the liquid ejecting head, foam members formed with closed cells are provided in the liquid flow paths.

13 Claims, 6 Drawing Sheets

LIQUID EJECTING HEAD, LIQUID EJECTING HEAD UNIT AND LIQUID EJECTING APPARATUS

The entire disclosure of Japanese Patent Application No: 2010-021894, filed Feb. 3, 2010 are expressly incorporated by reference herein.

BACKGROUND

1. Technical Field

The present invention relates to a liquid ejecting head, a liquid ejecting head unit and a liquid ejecting apparatus which eject liquid, in particular, to an ink jet recording head, an ink jet recording head unit and an ink jet recording apparatus which discharge ink as liquid.

2. Related Art

As a typical example of a liquid ejecting head, an ink jet recording head which discharges ink droplets from a nozzle opening by utilizing pressure generated by displacement of a piezoelectric element has been known, for example. In the ink jet recording head, a part of a pressure generation chamber communicating with the nozzle opening is constituted by a vibration plate. The vibration plate is deformed by the piezoelectric element so as to apply pressure to ink supplied to the pressure generation chamber. With this, ink droplets are discharged from the nozzle opening.

In such ink jet recording head, if pressure is applied to ink in the pressure generation chamber, a pressure wave is generated in the pressure generation chamber. The pressure wave propagates to a reservoir communicating with the pressure generation chamber. However, unless the pressure wave is attenuated by some way, the pressure wave further propagates to another pressure generation chamber and excellent ink dischargeability cannot be obtained.

Therefore, an ink jet recording head in which a compliance substrate is provided on one surface side of a reservoir and a thin-walled compliance portion is formed has been proposed (for example, see, JP-A-2004-042559). The compliance portion is deformed by pressure fluctuation in the reservoir as an ink chamber which is common to the pressure generation chambers so that energy of the pressure wave is absorbed.

However, if a compliance substrate made of a film or a thin metal plate is provided so as to form a compliance portion, there has arisen a problem that parts processings and assembling are complicated to increase the manufacturing cost. Further, a sufficient effect cannot be obtained unless a compliance portion having a large area to some extent is formed. Therefore, there arises a problem that an apparatus cannot be reduced in size.

Such problems may arise not only in the ink jet recording head but also in liquid ejecting heads which eject liquid other than ink.

SUMMARY

An advantage of some aspects of the invention is to provide a liquid ejecting head, a liquid ejecting head unit, and a liquid ejecting apparatus of which manufacturing costs and sizes can be reduced.

A liquid ejecting head according to an aspect of the invention includes a pressure generation chamber that communicates with a nozzle opening from which liquid droplets are discharged, a liquid flow path that communicates with the pressure generation chamber, and a pressure generation unit that generates pressure for discharging liquid droplets in the pressure generation chamber. In the liquid ejecting head, a foam member formed with closed cells is provided in the liquid flow path.

In the aspect of the invention, a foam member of which amount of deformation due to pressure fluctuation is large is provided in a liquid flow path. Therefore, the foam member can effectively absorb energy of pressure waves in accompaniment with the pressure fluctuation in each pressure generation chamber with a small area in the liquid flow path. This makes it possible to reduce the head in size. Further, the cost can be reduced in comparison with a case where a compliance substrate made of a film or a thin metal plate is provided.

According to the aspect of the invention, it is preferable that a part of a wall surface, which constitutes a part of the liquid flow path and defines a reservoir serving as a liquid chamber which is common to a plurality of pressure generation chambers be formed with the foam member. With this configuration, energy of pressure waves in accompaniment with the pressure fluctuation in each pressure generation chamber or pressure waves generated when liquid is introduced to the reservoir from the outside can be absorbed by one foam member.

As a preferable aspect of the invention, it is preferable that the liquid ejecting head further include a penetration portion which penetrates through from the reservoir to the outside and the foam member be provided in the penetration portion.

As another preferable aspect of the invention, it is preferable that a concave portion be provided on the reservoir and the foam member be provided in the concave portion.

Further, a liquid ejecting head unit according to another aspect of the invention includes equal to or more than two liquid ejecting heads according to the above aspects of the invention.

In the aspect of the invention, a liquid ejecting head unit of which cost and size are reduced can be realized.

Further, a liquid ejecting apparatus according to another aspect of the invention includes the liquid ejecting head according to the above aspects of the invention.

In the aspect of the invention, a liquid ejecting apparatus of which cost and size are reduced can be realized.

Further, a liquid ejecting apparatus according to another aspect of the invention includes the liquid ejecting head unit according to the above aspect of the invention. With this, a liquid ejecting apparatus which ejects different liquids can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail with reference to embodiments.

First Embodiment

Figure 1:
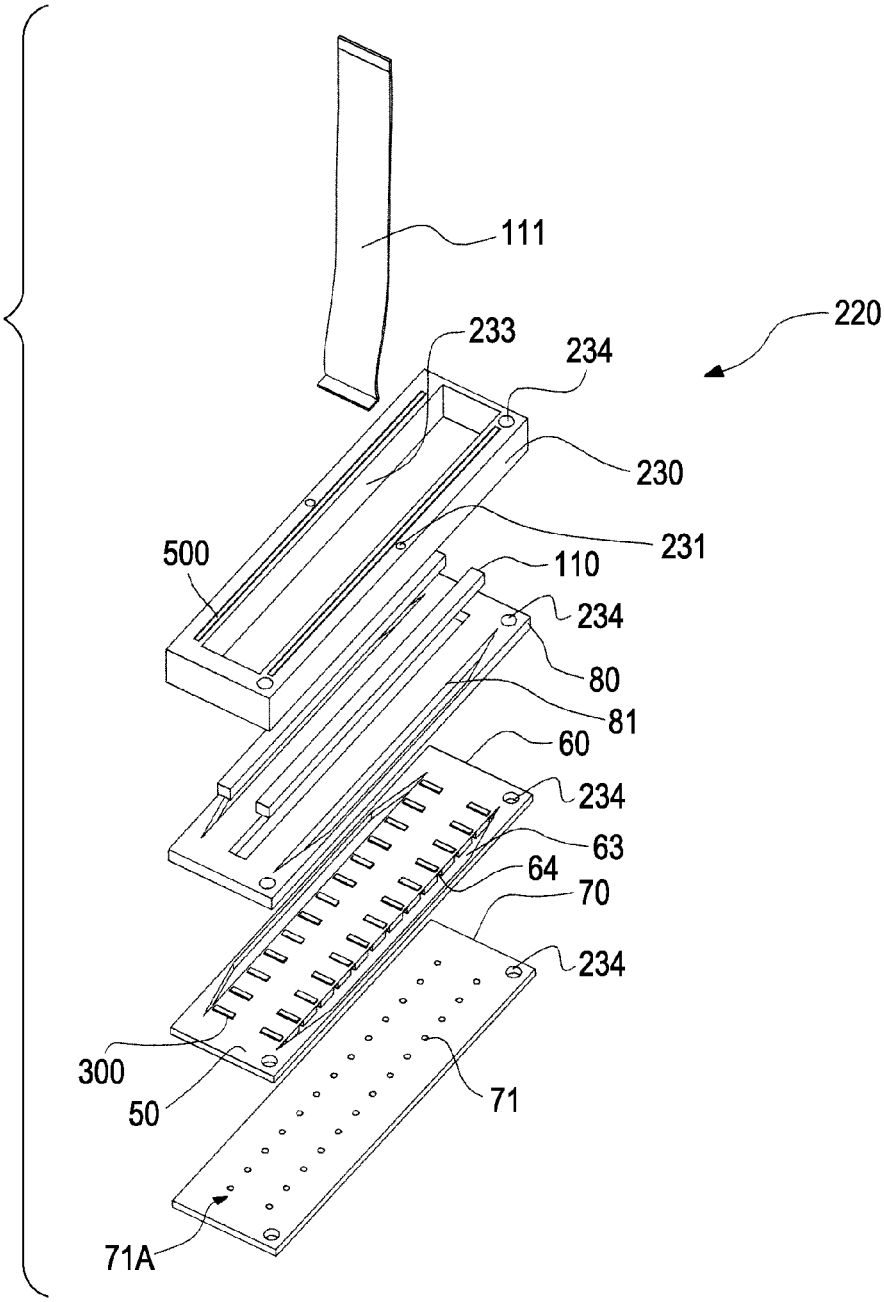
FIG. 1 is an exploded perspective view illustrating a head according to a first embodiment.
Figure 2:
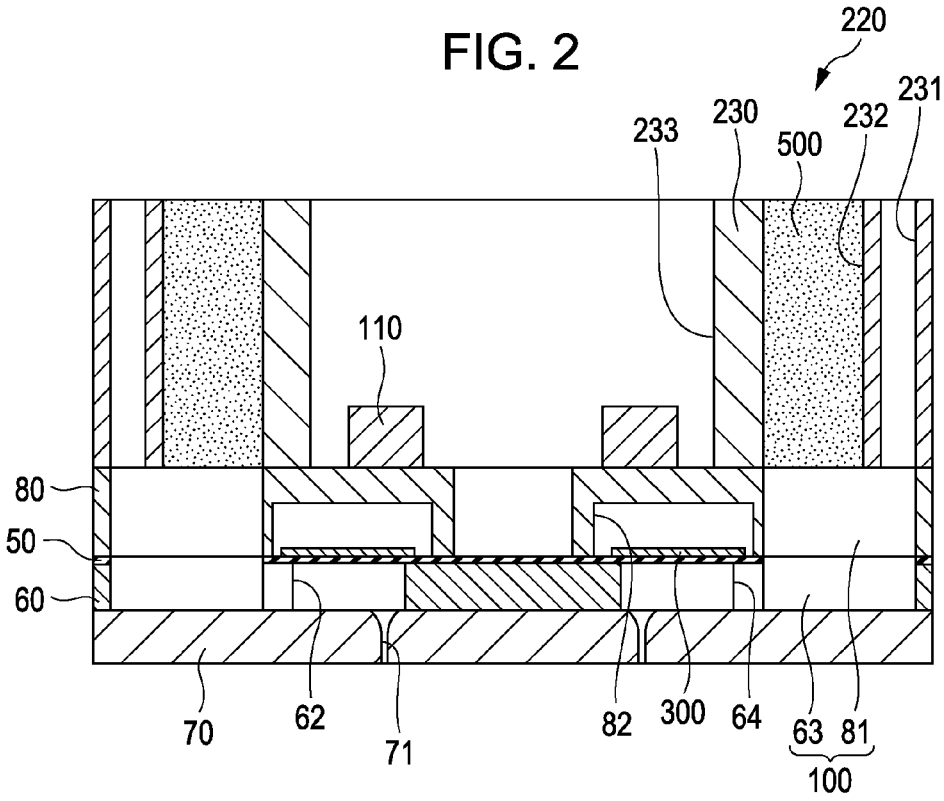
FIG. 2 is a cross-sectional view illustrating the head according to the first embodiment.

FIG. 1 is an exploded perspective view illustrating an ink jet recording head as an example of a liquid ejecting head according to the first embodiment of the invention. FIG. 2 is a cross-sectional view illustrating the ink jet recording head.

As shown in FIGS. 1 and 2, a flow path formation substrate 60 constituting an ink jet recording head 220 is made of a silicon single crystal substrate in the embodiment. An elastic film 50 made of silicon dioxide is formed on one surface side of the flow path formation substrate 60. Two rows of pressure generation chambers 62 are formed on the flow path formation substrate 60 by performing anisotropic etching from the other surface side of the flow path formation substrate 60. A plurality of pressure generation chambers 62 divided by a plurality of separation walls are arranged in parallel in the width direction. Communicating portions 63 are formed on outer sides of the rows of the pressure generation chambers 62 in the longitudinal direction thereof. Each communicating portion 63 communicates with a reservoir portion 81 and constitutes a reservoir 100 serving as an ink chamber common to the pressure generation chambers 62. The reservoir portion 81 is provided on a reservoir formation substrate 80, which will be described later. Further, each communicating portion 63 is communicated with one end of each of the pressure generation chambers 62 in the longitudinal direction thereof through supply paths 64. That is to say, in the embodiment, the pressure generation chambers 62, the communicating portions 63 and the supply paths 64 are provided on the flow path formation substrate 60.

A nozzle plate 70 in which nozzle openings 71 are formed is fixedly adhered to an opening surface side of the flow path formation substrate 60 with adhesive. It is to be noted that the nozzle openings 71 in the nozzle plate 70 are provided in a perforating manner so as to communicate with the pressure generation chambers 62 at a side opposite to the supply paths 64. In the embodiment, since two rows of the pressure generation chambers 62 are provided in parallel on the flow path formation substrate 60, two nozzle rows 71A formed of the nozzle openings 71 are provided in one head 220. Further, in the embodiment, a surface of the nozzle plate 70 on which the nozzle openings 71 are opened corresponds to a liquid ejection surface. For example, a silicon single crystal substrate, a metal substrate such as a stainless steel (SUS), or the like can be used for such nozzle plate 70.

On the other hand, piezoelectric elements 300 are formed on the elastic film 50 at a side opposite to the opening surface of the flow path formation substrate 60. A first electrode made of a metal, a piezoelectric layer made of a piezoelectric material such as lead zirconate titanate (PZT) and a second electrode made of a metal are sequentially laminated so as to form the piezoelectric element 300.

A reservoir formation substrate 80 is bonded onto the flow path formation substrate 60 on which such piezoelectric elements 300 are formed. The reservoir formation substrate 80 has reservoir portions 81 constituting at least a part of the reservoirs 100. In the embodiment, each reservoir portion 81 is formed over the width direction of the pressure generation chamber 62 while penetrating through the reservoir formation substrate 80 in the thickness direction. As described above, the reservoir portion 81 is communicated with the communicating portion 63 on the flow path formation substrate 60 so as to constitute the reservoir 100 as an ink chamber which is common to the pressure generation chambers 62.

In the embodiment, the supply paths 64 and the reservoirs 100 (the communicating portions 63, the reservoir portions 81) correspond to liquid flow paths communicating with the pressure generation chambers 62.

Further, piezoelectric element holders 82 having a space to an extent that the motions of the piezoelectric elements 300 are not hindered are provided in regions opposed to the piezoelectric elements 300, on the reservoir formation substrate 80.

Further, driving circuits 110 each of which is formed with a semiconductor integrated circuit (IC) and the like for driving each piezoelectric element 300 are provided on the reservoir formation substrate 80. Each terminal of the driving circuit 110 is connected to a leader line which is led out from an individual electrode of each piezoelectric element 300 through a bonding wire (not shown). Then, each terminal of the driving circuit 110 is connected to the outside through an external wiring 111 such as a flexible printed circuit (FPC) so as to receive various types of signals such as a printing signal from the outside through the external wiring 111.

Further, a head case 230 is fixed onto such reservoir formation substrate 80. Ink supply communication paths 231 are provided in the head case 230. Each ink supply communication path 231 communicates with each reservoir 100 and an ink supply path (not shown) to supply ink from the ink supply path to the reservoir 100.

Further, penetration portions 232 which penetrate through the head case 230 in the thickness direction from the reservoirs 100 are provided in the head case 230. Foam members 500 formed with closed cells are provided in the penetration portions 232. That is to say, each foam member 500 is provided in each penetration portion 232 so that a part of the foam member 500 serves as a part of a surface of wall defining each reservoir 100.

Each foam member 500 is made of closed cell foam. The closed cell foam indicates foam having a water absorption rate of equal to or lower than 5% (Rubber Terminology Dictionary, published by The Society of Rubber Industry, Japan). The foam member 500 is not particularly limited thereto as long as the material thereof has excellent resistance to ink. For example, resin foam such as polypropylene and polyethylene, rubber foam such as silicone, chloroprene, natural rubber, fluoro-rubber, EPDM (ethylene-propylene diene monomer) or the like can be exemplified as the material of the foam member 500. Further, an expansion ratio of the foam member 500 is not limited thereto and it is sufficient that the expansion ratio of the foam member 500 is appropriately adjusted such that the foam member 500 has a predetermined deformation amount with respect to pressure fluctuation. Further, the foam member 500 formed with closed cells has a surface layer portion of a skin layer. The skin layer indicates a smooth layer having a density higher than that of an inner portion, that is, a dense layer. Air bubbles are suppressed from being retained on the surface of the foam member 500 by making the skin layer be a part of a wall surface of the liquid flow path. This makes it possible to suppress ink supply failure or discharging failure.

A driving circuit holder 233 which penetrates through the head case 230 in the thickness direction is provided in the head case 230 at a region opposed to the driving circuits 110 provided on the reservoir formation substrate 80. The external wiring 111 is inserted through the driving circuit holder 233 so as to be connected to the driving circuits 110.

Pin insertion holes 234 are provided at two corners of each member constituting the head 220. Pins for positioning each member at the time of assembly are inserted into the pin insertion holes 234. Then, pins are inserted into the pin insertion holes 234 so as to bond the members to each other while relatively positioning each member. With this, the head 220 is integrally assembled.

In the ink jet recording head having such configuration according to the embodiment, ink is taken from an ink cartridge through the ink supply communication paths 231 so as to fill the inner portion from the reservoirs 100 to the nozzle openings 71 with the ink. Thereafter, a voltage is applied to each piezoelectric element 300 corresponding to each pressure generation chamber 62 in accordance with a recording signal transmitted from the driving circuits 110. Then, the elastic film 50, and the piezoelectric elements 300 are deflected and deformed. Therefore, pressures in the pressure generation chambers 62 are increased so that ink droplets are discharged from the nozzle openings 71.

In such a manner, pressure fluctuation is caused in the reservoirs 100 in accompaniment with the pressure fluctuation in the pressure generation chambers 62. However, the foam members 500 formed with closed cells are concaved (deformed) so as to absorb energy of the pressure waves. Therefore, a so-called cross-talk is suppressed. The cross-talk is a phenomenon in which a displacement amount in a case where a plurality of piezoelectric elements 300 are driven at the same time and a displacement amount in a case where one piezoelectric element 300 selected from the plurality of the piezoelectric elements 300 is driven are different from each other. Therefore, excellent ink dischargeability can be obtained while making ink dischargeability uniform. Further, the foam members 500 formed with closed cells can absorb energy of pressure waves generated when liquid is introduced into the reservoirs from the outside. That is, the foam members 500 formed with closed cells can absorb pressure waves when pressure fluctuation is caused in the reservoirs 100.

Each foam member 500 does not substantially absorb ink because the foam member 500 is formed with closed cells. Further, a displacement amount of the foam member 500 due to pressure fluctuation is significantly large. Therefore, the foam member 500 can effectively absorb energy of the pressure waves with a small area.

The foam member 500 has a significantly large displacement amount with respect to pressure in comparison with a displacement amount of the existing compliance substrate (compliance portion) made of a film or a thin metal plate. Therefore, an area of the foam member 500 can be made smaller than that of the existing compliance portion so as to reduce the size of the head 220. Further, the head 220 adopting the foam member 500 can be easily manufactured at low cost in comparison with the existing case of manufacturing the head where the compliance substrate made of a film or a thin metal plate is provided because it is sufficient that only the foam member 500 formed with closed cells is provided.

Further, in the embodiment, each foam member 500 is configured to be provided in each penetration portion 232 in the head case 230. Therefore, the foam member 500 can absorb energy of pressure waves in accompaniment with pressure fluctuation in each pressure generation chamber while ensuring the same volume of the liquid flow path as that in the existing technique. Accordingly, a supply amount of ink can be sufficiently ensured.

In addition, a shape of the penetration portion 232 is not particularly limited to the above embodiment. In the embodiment, each penetration portion 232 is provided over the direction in which the pressure generation chambers 62 are arranged in parallel, as shown in FIG. 1. Therefore, energy of the pressure waves of all the pressure generation chambers 62 can be uniformly absorbed.

Figure 3:
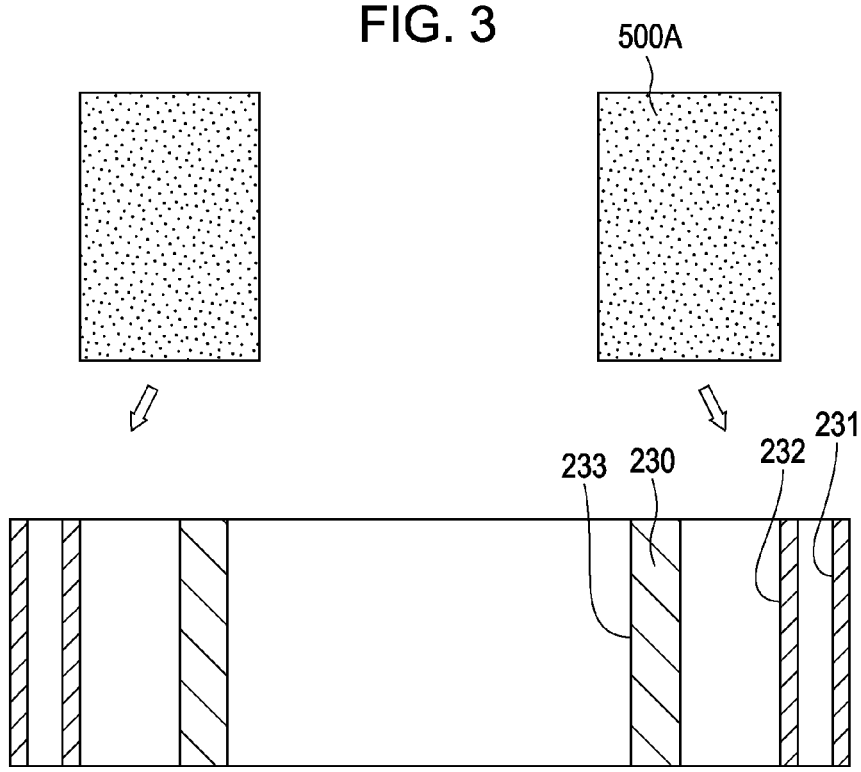
FIG. 3 is a cross-sectional view illustrating an example of a method of manufacturing the head according to the first embodiment.
Figure 4:
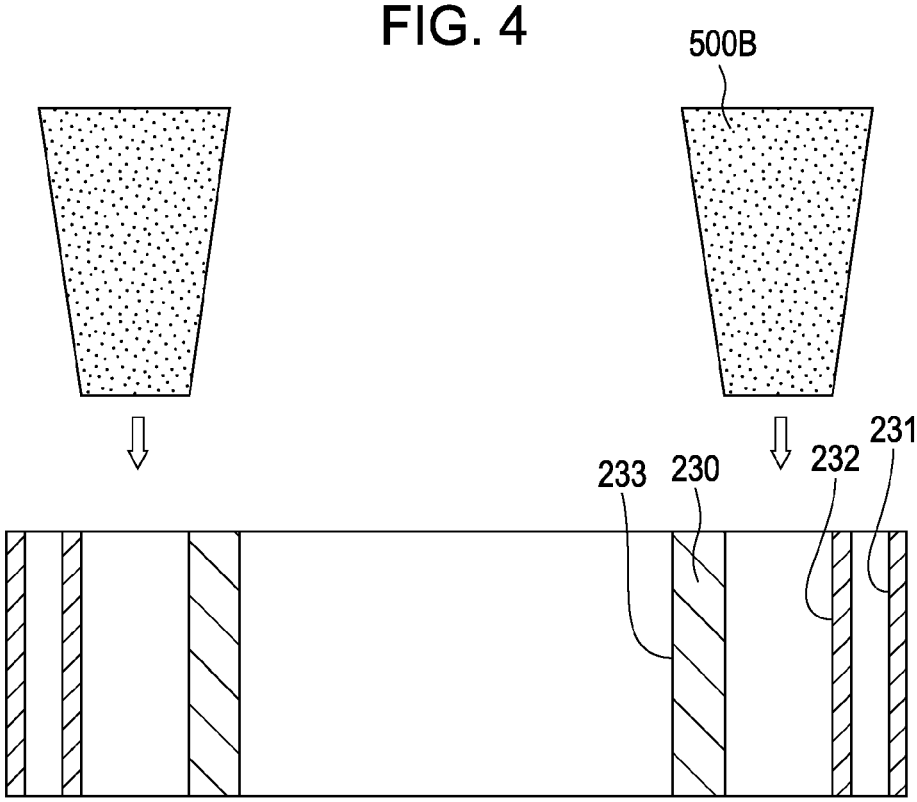
FIG. 4 is a cross-sectional view illustrating an example of the method of manufacturing the head according to the first embodiment.
Figure 5:
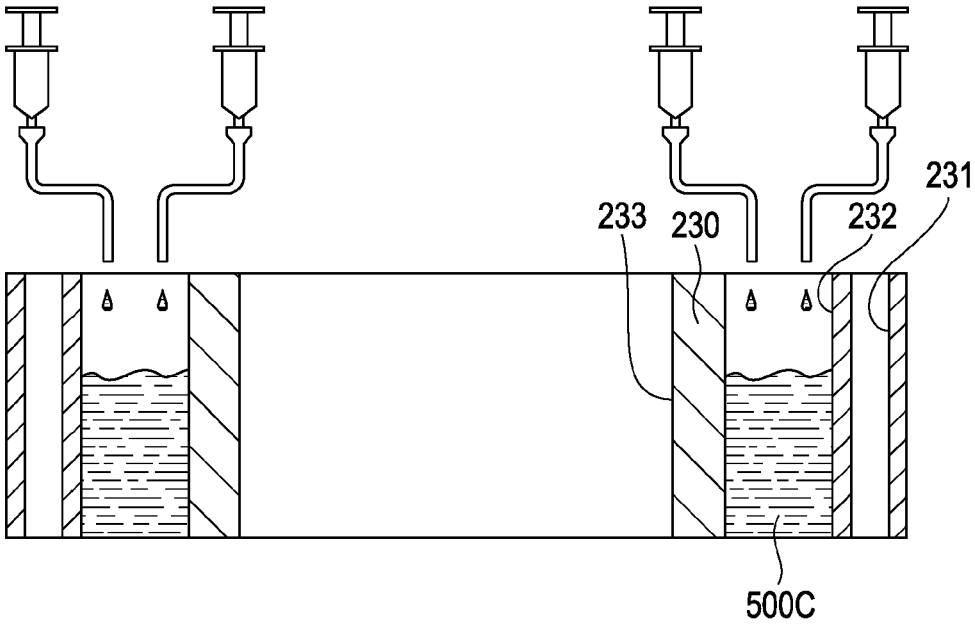
FIG. 5 is a cross-sectional view illustrating an example of the method of manufacturing the head according to the first embodiment.

Next, a method of manufacturing the ink jet recording head according to the embodiment is described. To be more specific, a method of providing the foam members 500 in the penetration portions 232 of the head case 230 is simply described. FIGS. 3 through 5 are cross-sectional views illustrating the method of providing the foam members 500 in the penetration portions 232 of the head case 230 according to the embodiment.

For example, as shown in FIG. 3, foam members 500A are pressed into the penetration portions 232 so that the foam members 500 are provided in the penetration portions 232 of the head case 230. At this time, the length of the foam member 500A is the same as that of the penetration portion 232 of the head case 230 in the longitudinal direction and a thickness of the foam member 500A is larger than that of the penetration portion 232 of the head case 230 in the width direction. That is, as shown in FIG. 2, the foam members 500 are fixed in the penetration portions 232 so that the penetration portions 232 are made to be in the sealed state. It is to be noted that the foam members 500A may be pressed into the penetration portions 232 after an adhesive is coated on the surfaces of the foam members 500A.

Further, as shown in FIG. 4, foam members 500B may be pressed into the penetration portions 232. At this time, the length of the foam member 500B is the same as that of the penetration portion 232 of the head case 230 in the longitudinal direction, and a thickness of the foam member 500B in the width direction is gradually decreased toward the reservoir formation substrate (not shown). That is to say, the foam member 500B of which upper surface area is larger than that of the penetration portion 232 and of which lower surface area is substantially the same as that of the penetration portion 232, may be pressed into the penetration portion 232. With this, as shown in FIG. 2, the foam members 500 are fixed in the penetration portions 232 so that the penetration portions 232 are made to be in the sealed state. It is to be noted that the foam members 500B may be pressed into the penetration portions 232 after an adhesive is coated on the surfaces of the foam members 500B.

Another foam member 500 may be provided in the penetration portions 232 of the head case 230 by using a material which foams and becomes hardened when being mixed. For example, foam members 500C can be provided in the penetration portions 232 as follows. The head case 230 is fixed onto a predetermined substrate and a two-liquid mixing type foam material is poured to the penetration portions 232, as shown in FIG. 5 so that the two-liquid mixing type foam material is foamed and becomes hardened. In such a manner, the foam members 500C can be provided in the penetration portions 232. As the two-liquid mixing type foam material, a two-liquid mixing type silicone material can be used.

Second Embodiment

Figure 6:
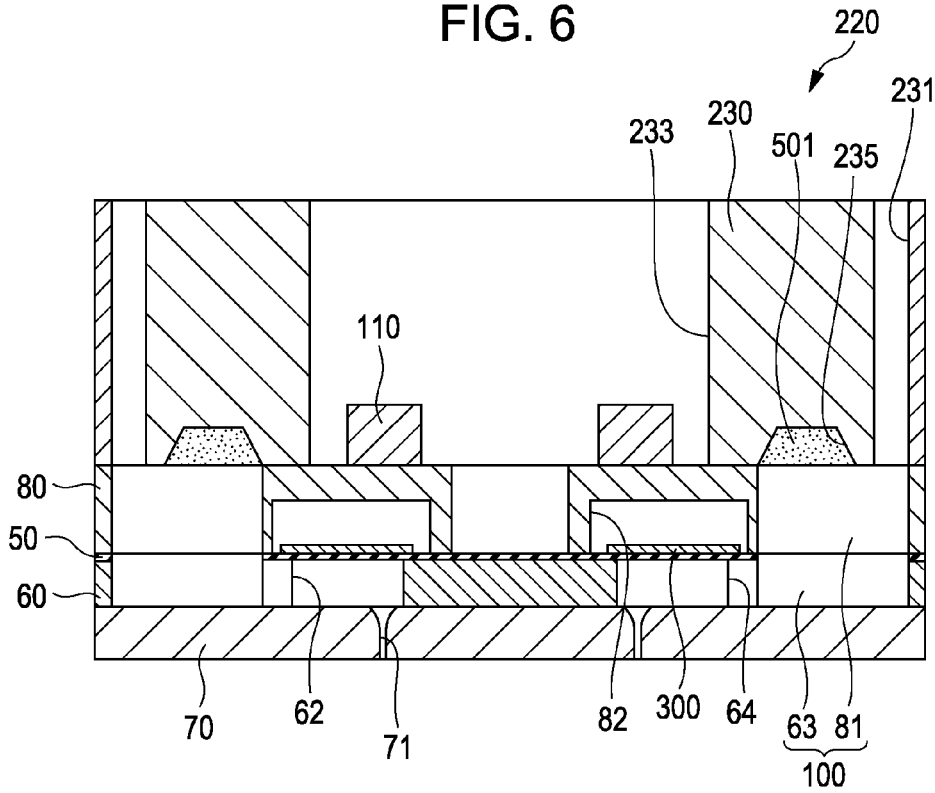
FIG. 6 is a cross-sectional view illustrating a head according to a second embodiment.

FIG. 6 is a cross-sectional view illustrating a recording head according to a second embodiment. Members of which operations are the same as those in the first embodiment are denoted with the same reference numerals and so description is not repeated.

As shown in FIG. 6, a concave portion 235 is provided on a part of a wall surface constituting each reservoir 100 of the head case 230, and a foam member 501 is provided in each concave portion 235. That is, the foam member 501 is provided in each concave portion 235 provided on the wall surface of each reservoir 100. Therefore, if pressure fluctuation is caused in the reservoir 100, the foam member 501 is concaved (deformed) in the thickness direction so as to absorb energy of the pressure waves. The foam member 501 does not substantially absorb ink because the foam member 501 is formed with closed cells. Further, a displacement amount of the foam member 501 due to pressure fluctuation is significantly large. Therefore, the foam member 501 can effectively absorb energy of the pressure waves at a small area.

Further, in the embodiment, a part of the wall surface of each reservoir 100 is constituted by the foam member 501. Therefore, the foam member 501 can absorb energy of pressure waves in accompaniment with pressure fluctuation of each pressure generation chamber. That is, the foam member 501 is provided in each concave portion 235 of the head case 230. Therefore, the foam member 501 can absorb energy of pressure waves in accompaniment with pressure fluctuation of each pressure generation chamber while ensuring the volume of the liquid flow path the same as the volume in the existing technique. Accordingly, a supply amount of ink can be sufficiently ensured.

Third Embodiment

Figure 7:
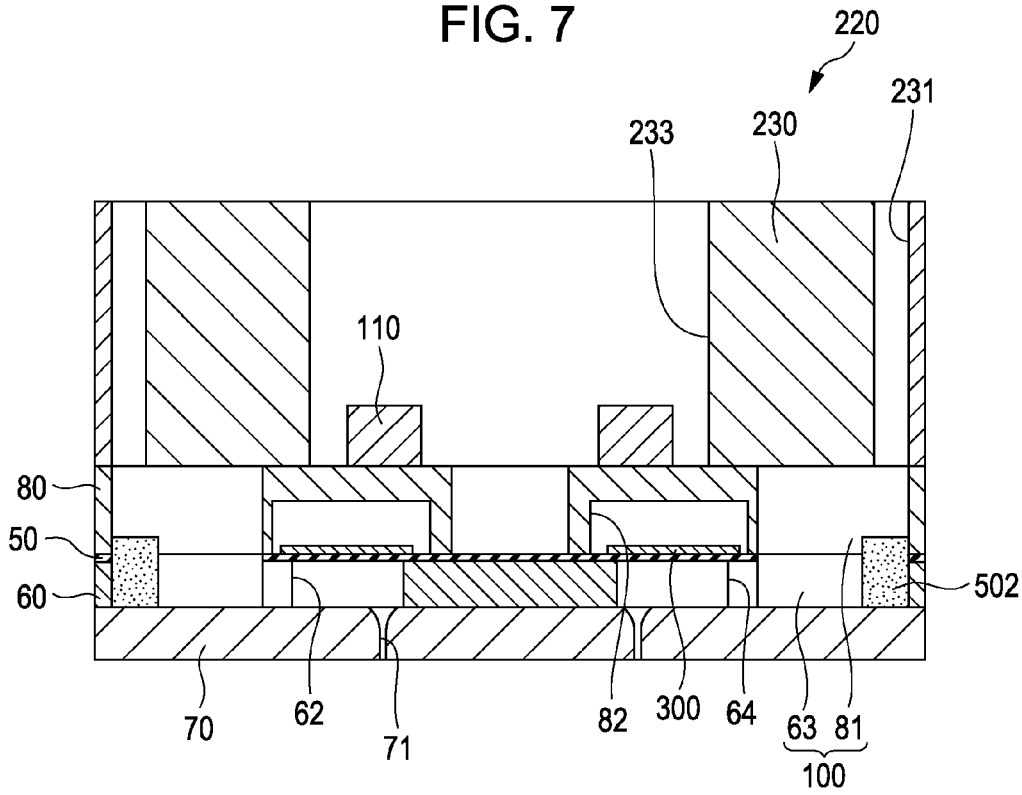
FIG. 7 is a cross-sectional view illustrating a head according to a third embodiment.

FIG. 7 is a cross-sectional view illustrating a recording head according to a third embodiment. Members of which operations are the same as those in the first embodiment are denoted with the same reference numerals and so description is not repeated.

As shown in FIG. 7, foam members 502 are provided on wall surfaces of the reservoir formation substrate 80. If pressure fluctuation is caused in each reservoir 100, each foam member 502 is concaved (deformed) in the thickness direction so as to absorb energy of the pressure waves by providing the foam member 502 on the liquid flow path (reservoir 100 in the embodiment). The foam member 502 does not substantially absorb ink because the foam member 502 is formed with closed cells. Further, a displacement amount of the foam member 502 due to pressure fluctuation is significantly large. Therefore, the foam member 502 can effectively absorb energy of the pressure waves at a small area. In the embodiment, pressure waves in accompaniment with the pressure fluctuation of each pressure generation chamber directly hit the foam members 502 or pressure waves generated when liquid is introduced into the reservoirs 100 from the outside directly hit the foam members 502. Therefore, energy of the pressure waves can be absorbed further effectively.

Another Embodiment

Figure 8:
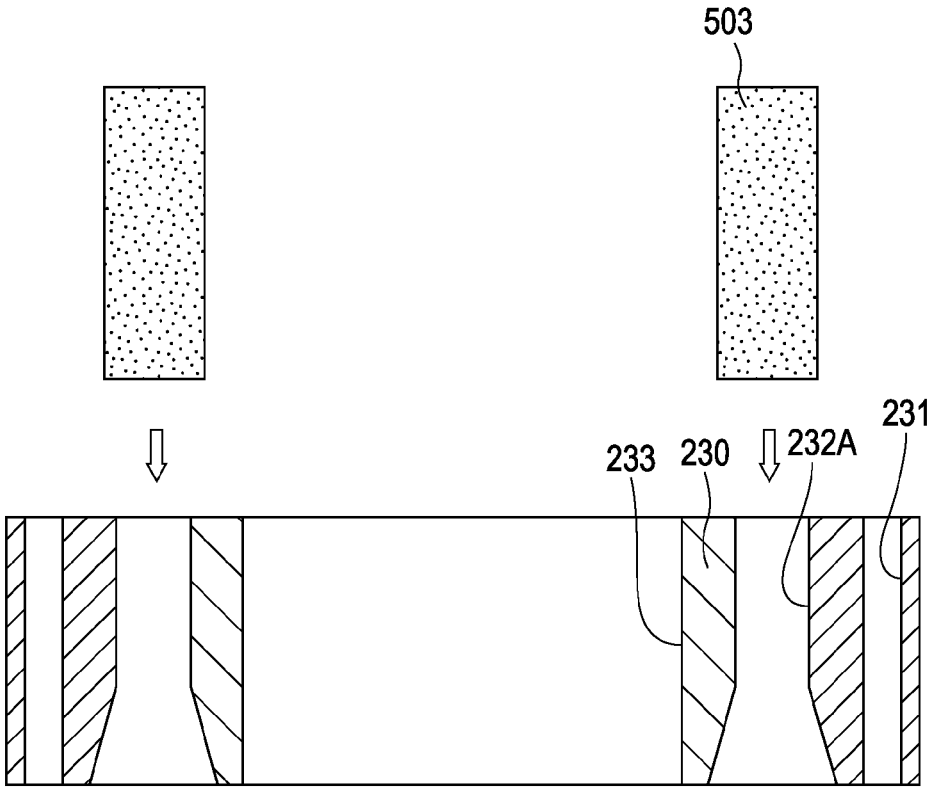
FIG. 8 is a cross-sectional view illustrating an example of a method of manufacturing a head according to another embodiment.

Hereinbefore, although embodiments of the invention have been described, basic configurations according to the invention are not limited to the above-described configurations. For example, a shape of the penetration portion of the head case 230 is not limited to the shapes in the first to third embodiments. For example, as shown in FIG. 8, the penetration portions 232A may have a shape of which area is gradually increased toward the reservoir formation substrate 80 from a predetermined position. In this case, for example, a foam member 503 having a surface of which area is substantially the same as an area of the penetration portion 232A on the side of the reservoir 100 may be pressed into each penetration portion 232A. Therefore, the foam members 503 can be fixed in the penetration portions 232A.

In addition, when the foam member is provided in the penetration portion of the head case 230, a sealing member may be provided on a surface of the head case opposite to the reservoir formation substrate 80 side in order to reliably prevent liquid leakage.

In the above embodiments, the foam member formed with closed cells is provided in the reservoir 100. However, when a liquid flow path other than the liquid flow path described in the embodiments is present, a foam member can be provided on such liquid flow path.

Figure 9:
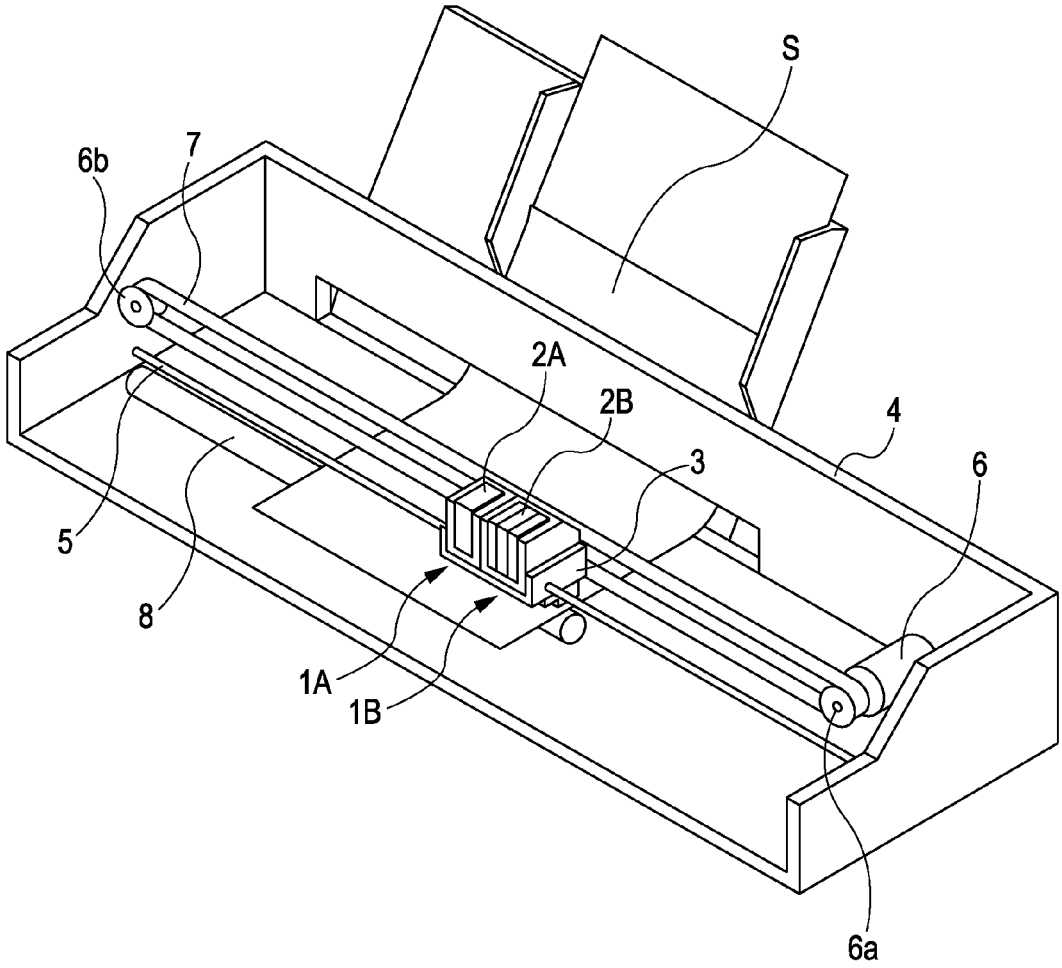
FIG. 9 is a schematic perspective view illustrating a recording apparatus according to an embodiment.

The ink jet recording head in each of the embodiments constitutes a part of a recording head unit including an ink flow path communicating with ink cartridges or the like and is mounted on a ink jet recording apparatus. FIG. 9 is a schematic view illustrating an example of the ink jet recording apparatus.

As shown in FIG. 9, cartridges 2A, 2B constituting ink supply units are detachably provided on recording head units 1A, 1B each of which has the ink jet recording head 220. A carriage 3 on which the recording head units 1A, 1B are mounted is provided on a carriage shaft 5 so as to be movable in the shaft direction. The carriage shaft 5 is attached to an apparatus main body 4. For example, the recording head unit 1A may discharge black ink composition and the recording head unit 1B may discharge color ink composition.

When a driving force of a driving motor 6 is transmitted to the carriage 3 through a plurality of gears (not shown) and a timing belt 7, the carriage 3 on which the recording head units 1A, 1B are mounted moves along the carriage shaft 5. On the other hand, a platen 8 is provided along the carriage shaft 5 on the apparatus main body 4. A recording sheet S as a recording medium such as a paper which is fed by a sheet feeding roller (not shown) is transported while being wound around the platen 8.

In an example as shown in FIG. 9, each of the ink jet recording head units 1A, 1B has one ink jet recording head 220. However, the configuration is not particularly limited thereto and one ink jet recording head unit 1A or 1B may have equal to or more than two ink jet recording heads.

Further, in the above embodiments, the invention has been described by exemplifying the ink jet recording head 220 which discharges ink droplets. However, the invention can be widely applied to the liquid ejecting heads in general. As another liquid ejecting head, various types of liquid ejecting heads can be exemplified such as a recording head which is used in an image recording apparatus like a printer, a color material ejecting head which is used for manufacturing a color filter of a liquid crystal display and the like, an electrode material ejecting head which is used for forming an electrode of an organic EL display and a field emission display (FED), a bioorganic compound ejecting head which is used for manufacturing biochips.

What is claimed is:

1. A liquid ejecting head comprising:

a pressure generation chamber that communicates with a nozzle opening from which liquid droplets are discharged;

a liquid flow path that communicates with the pressure generation chamber; and a pressure generation unit that generates pressure for discharging liquid droplets in the pressure generation chamber, wherein a foam member formed with closed cells is faced in the liquid flow path.

2. The liquid ejecting head according to claim 1, wherein a part of a wall surface, which constitutes a part of the liquid flow path and defines a reservoir serving as a liquid chamber common to a plurality of pressure generation chambers is formed with the foam member.

3. The liquid ejecting head according to claim 2, including a penetration portion which penetrates through from the reservoir to the outside, wherein the foam member is provided in the penetration portion.

4. The liquid ejecting head according to claim 2, wherein a concave portion is provided on the reservoir and the foam member is provided in the concave portion.

5. A liquid ejecting head unit comprising two or more liquid ejecting heads, each liquid eject head comprising:

a pressure generation chamber that communicates with a nozzle opening from which liquid droplets are discharged;

a liquid flow path that communicates with the pressure generation chamber; and a pressure generation unit that generates pressure for discharging liquid droplets in the pressure generation chamber, wherein a foam member formed with closed cells is faced in the liquid flow path.

6. A liquid ejecting apparatus comprising the liquid ejecting head unit according to claim 5.

7. The liquid ejecting head unit according to claim 5, wherein, for each liquid ejecting head, a part of a wall surface, which constitutes a part of the liquid flow path and defines a reservoir serving as a liquid chamber common to a plurality of pressure generation chambers is formed with the foam member.

8. The liquid ejecting head unit according to claim 7, each liquid injecting head including a penetration portion which penetrates through from the reservoir to the outside, wherein the foam member is provided in the penetration portion.

9. The liquid ejecting head unit according to claim 7, wherein, for each liquid ejecting head, a concave portion is provided on the reservoir and the foam member is provided in the concave portion.

10. A liquid ejecting apparatus comprising a liquid ejecting head, the liquid ejecting head comprising:

a pressure generation chamber that communicates with a nozzle opening from which liquid droplets are discharged;

a liquid flow path that communicates with the pressure generation chamber; and a pressure generation unit that generates pressure for discharging liquid droplets in the pressure generation chamber, wherein a foam member formed with closed cells is faced in the liquid flow path.

11. The liquid ejecting apparatus according to claim 10, wherein, for the liquid ejecting head, a part of a wall surface, which constitutes a part of the liquid flow path and defines a reservoir serving as a liquid chamber common to a plurality of pressure generation chambers is formed with the foam member.

12. The liquid ejecting apparatus according to claim 11, the liquid injecting head including a penetration portion which penetrates through from the reservoir to the outside, wherein the foam member is provided in the penetration portion.

13. The liquid ejecting apparatus according to claim 11, wherein, for the liquid ejecting head, a concave portion is provided on the reservoir and the foam member is provided in the concave portion.

* * * * *